US011274477B2

(12) United States Patent
Cumbo et al.

(10) Patent No.: US 11,274,477 B2
(45) Date of Patent: Mar. 15, 2022

(54) INTEGRATED DOOR PRESENTMENT MECHANISM FOR A LATCH

(71) Applicant: MAGNA CLOSURES INC., Newmarket (CA)

(72) Inventors: Francesco Cumbo, Pisa (IT); Luca Bigazzi, Ponsacco (IT)

( * ) Notice: Subject to any disclaimer, the term of this patent is extended or adjusted under 35 U.S.C. 154(b) by 876 days.

(21) Appl. No.: 15/996,724

(22) Filed: Jun. 4, 2018

(65) Prior Publication Data

US 2019/0003214 A1 Jan. 3, 2019

Related U.S. Application Data

(60) Provisional application No. 62/515,172, filed on Jun. 5, 2017, provisional application No. 62/639,073, filed on Mar. 6, 2018.

(51) Int. Cl.

| | |
|---|---|
| ***E05B 81/14*** | (2014.01) |
| ***E05B 81/20*** | (2014.01) |
| ***E05B 81/22*** | (2014.01) |
| ***E05B 47/06*** | (2006.01) |
| ***E05B 47/00*** | (2006.01) |
| ***E05B 81/70*** | (2014.01) |
| ***E05B 81/68*** | (2014.01) |
| ***E05B 81/24*** | (2014.01) |
| *E05B 81/34* | (2014.01) |
| *E05B 81/06* | (2014.01) |

(52) U.S. Cl.

CPC ..... *E05B 81/22* (2013.01); *E05B 47/0012* (2013.01); *E05B 47/0607* (2013.01); *E05B 81/14* (2013.01); *E05B 81/20* (2013.01); *E05B 81/25* (2013.01); *E05B 81/68* (2013.01); *E05B 81/70* (2013.01); *E05B 81/06* (2013.01); *E05B 81/34* (2013.01); *E05B 2047/0026* (2013.01); *Y10T 292/1082* (2015.04)

(58) Field of Classification Search

CPC ... Y10T 292/1082; E05B 81/12; E05B 81/20; E05B 47/0012; E05B 81/22

See application file for complete search history.

(56) References Cited

U.S. PATENT DOCUMENTS

| | | | |
|---|---|---|---|
| 2,865,045 | A | 12/1958 | Miller |
| 3,344,554 | A | 10/1967 | Misaka et al. |

(Continued)

FOREIGN PATENT DOCUMENTS

| | | | |
|---|---|---|---|
| CN | 105089383 | B | 2/2018 |
| CN | 108301727 | A | 7/2018 |

(Continued)

*Primary Examiner* — Carlos Lugo

(57) ABSTRACT

A latch assembly for a closure panel of a vehicle, the latch assembly including: a housing; a ratchet and pawl pivotally coupled to the housing, the ratchet for interaction with a striker such that one of the latch assembly and the striker being mounted on the closure panel and the other of the latch assembly and the striker being mounted on a body of the vehicle; a presentment mechanism mounted to the housing having one or more presentment members, such that the one or more presentment members is driven for influencing a position of the ratchet during presentment of the striker out of a slot of the ratchet to a presentment position; and an actuator for engaging with the presentment mechanism to effect the driven of the one or more presentment members.

19 Claims, 9 Drawing Sheets

(56) References Cited

U.S. PATENT DOCUMENTS

| | | | | | |
|---|---|---|---|---|---|
| 3,451,702 | A | | 6/1969 | Little | |
| 3,605,459 | A | | 9/1971 | Van Dalen | |
| 4,183,177 | A | | 1/1980 | Kurdziel | |
| 4,395,064 | A | * | 7/1983 | Bellot | E05B 81/20 292/201 |
| 4,518,180 | A | * | 5/1985 | Kleefeldt | E05B 81/06 292/201 |
| 4,691,584 | A | * | 9/1987 | Takaishi | E05B 81/06 292/144 |
| 4,906,035 | A | * | 3/1990 | Nagai | E05B 81/20 292/201 |
| 5,092,637 | A | | 3/1992 | Miller | |
| 5,228,239 | A | | 7/1993 | Heo | |
| 5,273,324 | A | * | 12/1993 | Kobayashi | E05B 81/20 292/201 |
| 5,369,911 | A | | 12/1994 | Fortunato | |
| 5,423,582 | A | | 6/1995 | Kleefeldt | |
| 5,998,746 | A | | 12/1999 | Clark | |
| 6,079,237 | A | * | 6/2000 | Hochart | E05B 81/14 292/201 |
| 6,131,337 | A | * | 10/2000 | Machida | E05B 81/20 292/201 |
| 6,338,536 | B1 | | 1/2002 | Ueno et al. | |
| 6,557,910 | B2 | * | 5/2003 | Amano | E05B 81/14 292/201 |
| 6,575,507 | B2 | | 6/2003 | Reddmann | |
| 6,659,515 | B2 | * | 12/2003 | Raymond | E05B 81/20 292/201 |
| 7,204,530 | B2 | | 4/2007 | Lee | |
| 7,688,179 | B2 | | 3/2010 | Kurpinski et al. | |
| 8,326,497 | B2 | | 12/2012 | Shahidi et al. | |
| 8,584,402 | B2 | | 11/2013 | Yamaguchi | |
| 8,684,424 | B2 | * | 4/2014 | Wattebled | E05B 81/64 292/216 |
| 8,739,468 | B2 | | 6/2014 | Yamaguchi et al. | |
| 8,915,524 | B2 | | 12/2014 | Charnesky et al. | |
| 9,003,707 | B2 | | 4/2015 | Reddmann | |
| 9,330,552 | B2 | | 5/2016 | Gotz et al. | |
| 9,382,741 | B2 | | 7/2016 | Konchan et al. | |
| 9,995,066 | B1 | | 6/2018 | Ottolini et al. | |
| 10,047,554 | B2 | | 8/2018 | Dudar et al. | |
| 10,119,308 | B2 | | 11/2018 | Linden et al. | |
| 10,267,068 | B2 | | 4/2019 | Van Wiemeersch et al. | |
| 10,273,725 | B2 | | 4/2019 | Van Wiemeersch et al. | |
| 10,323,442 | B2 | | 6/2019 | Kleve et al. | |
| 10,329,823 | B2 | | 6/2019 | Khan et al. | |
| 10,377,343 | B2 | | 8/2019 | Krishnan | |
| 10,422,166 | B2 | | 9/2019 | Papanikolaou et al. | |
| 10,435,924 | B1 | | 10/2019 | Salter et al. | |
| 10,480,221 | B2 | | 11/2019 | Cumbo | |
| 10,494,838 | B2 | | 12/2019 | Patel et al. | |
| 10,526,821 | B2 | | 1/2020 | Krishnan et al. | |
| 10,563,436 | B2 | | 2/2020 | Krishnan et al. | |
| 10,577,840 | B2 | | 3/2020 | Rrumbullaku et al. | |
| 10,584,526 | B2 | | 3/2020 | Linden et al. | |
| 10,604,970 | B2 | | 3/2020 | Briggs et al. | |
| 10,633,893 | B2 | | 4/2020 | Harajli et al. | |
| 10,665,140 | B1 | | 5/2020 | Ahn et al. | |
| 10,697,224 | B2 | | 6/2020 | Linden et al. | |
| 10,711,503 | B2 | | 7/2020 | Linden et al. | |
| 10,822,848 | B2 | | 11/2020 | Worden et al. | |
| 2003/0222614 | A1 | | 12/2003 | Whinnery et al. | |
| 2008/0100092 | A1 | | 5/2008 | Gao et al. | |
| 2013/0104459 | A1 | | 5/2013 | Patel et al. | |
| 2013/0138303 | A1 | | 5/2013 | McKee et al. | |
| 2015/0330117 | A1 | | 11/2015 | Van Wiemeersch et al. | |
| 2017/0260790 | A1 | | 9/2017 | Sauerwein et al. | |
| 2017/0284142 | A1 | | 10/2017 | Jaranson et al. | |
| 2018/0038146 | A1 | | 2/2018 | Linden et al. | |
| 2018/0038147 | A1 | | 2/2018 | Linden et al. | |
| 2018/0080270 | A1 | | 3/2018 | Khan et al. | |
| 2018/0106081 | A1 | | 4/2018 | Bendel | |
| 2018/0179788 | A1 | | 6/2018 | Oxley et al. | |
| 2019/0003214 | A1 | | 1/2019 | Cumbo et al. | |
| 2019/0119965 | A1 | | 4/2019 | Hernandez et al. | |
| 2019/0203508 | A1 | | 7/2019 | Harajli et al. | |
| 2019/0292817 | A1 | | 9/2019 | Tomaszewski | |
| 2020/0011111 | A1 | | 1/2020 | Khan et al. | |
| 2020/0123835 | A1 | | 4/2020 | Gruber et al. | |
| 2020/0131836 | A1 | | 4/2020 | Ottino | |
| 2020/0270928 | A1 | | 8/2020 | Cumbo | |
| 2020/0284068 | A1 | | 9/2020 | Cumbo et al. | |

FOREIGN PATENT DOCUMENTS

| | | | | | |
|---|---|---|---|---|---|
| CN | 111356817 | A | | 6/2020 | |
| DE | 2906860 | A | * | 9/1980 | |
| DE | 3333746 | A | * | 6/1985 | |
| DE | 19905774 | A1 | * | 8/2000 | E05B 81/20 |
| DE | 19700887 | B4 | * | 7/2006 | E05B 81/20 |
| DE | 102015003917 | A1 | | 9/2016 | |
| DE | 102017101997 | A1 | * | 8/2018 | E05B 81/40 |
| DE | 102017113653 | A1 | * | 12/2018 | E05B 81/40 |
| EP | 3073040 | A2 | | 9/2016 | |
| FR | 2526996 | A1 | | 11/1983 | |
| FR | 3086685 | A1 | | 4/2020 | |
| KR | 20100123658 | A | * | 11/2010 | E05B 81/20 |
| WO | WO-2011052540 | A1 | * | 5/2011 | E05B 81/14 |
| WO | 2015048876 | A1 | | 4/2015 | |
| WO | 2016031162 | A1 | | 3/2016 | |
| WO | 2017160787 | A1 | | 9/2017 | |
| WO | 2020120055 | A1 | | 6/2020 | |

* cited by examiner

INTEGRATED DOOR PRESENTMENT MECHANISM FOR A LATCH

CROSS-REFERENCE TO RELATED APPLICATIONS

This application claims the benefit of U.S. Provisional Patent Application No. 62/515,172, filed on Jun. 5, 2017; the entire contents of which are hereby incorporated by reference herein.

This application claims the benefit of U.S. Provisional Patent Application No. 62/639,073, filed on Mar. 6, 2018; the entire contents of which are hereby incorporated by reference herein application

BACKGROUND

This disclosure relates to a presentment mechanism for a closure panel.

BACKGROUND

Current door latching systems which do not employ physical handles to activate opening of the door need some kind of door presenter to provide for door opening after latch release has occurred. Presentment of the door facilitates the vehicle user to grab the door and move it to the fully open door position. Current door designs provide for an additional presentment actuator to achieve the required presentment operation, which is disadvantageous due to extra materials and cost associated with multiple actuation mechanisms.

SUMMARY

It is an object of the present invention to provide a presentment mechanism of a latch assembly to obviate or mitigate at least one of the above presented disadvantages.

An aspect provided is a latch assembly for a closure panel of a vehicle, the latch assembly including: a housing; a ratchet and pawl pivotally coupled to the housing, the ratchet for interaction with a striker such that one of the latch assembly and the striker being mounted on the closure panel and the other of the latch assembly and the striker being mounted on a body of the vehicle; a presentment mechanism mounted to the housing having one or more presentment members, such that the one or more presentment members is driven for influencing a position of the ratchet during presentment of the striker out of a slot of the ratchet to a presentment position; and an actuator for engaging with the presentment mechanism to effect said driven of the one or more presentment members.

A further aspect provided is a latch lever driven by the actuator for performing a cinch operation by moving the ratchet from a secondary position to a primary position.

BRIEF DESCRIPTION OF THE FIGURES

The foregoing and other aspects will now be described by way of example only with reference to the attached drawings, in which.

DESCRIPTION

Figure 1:
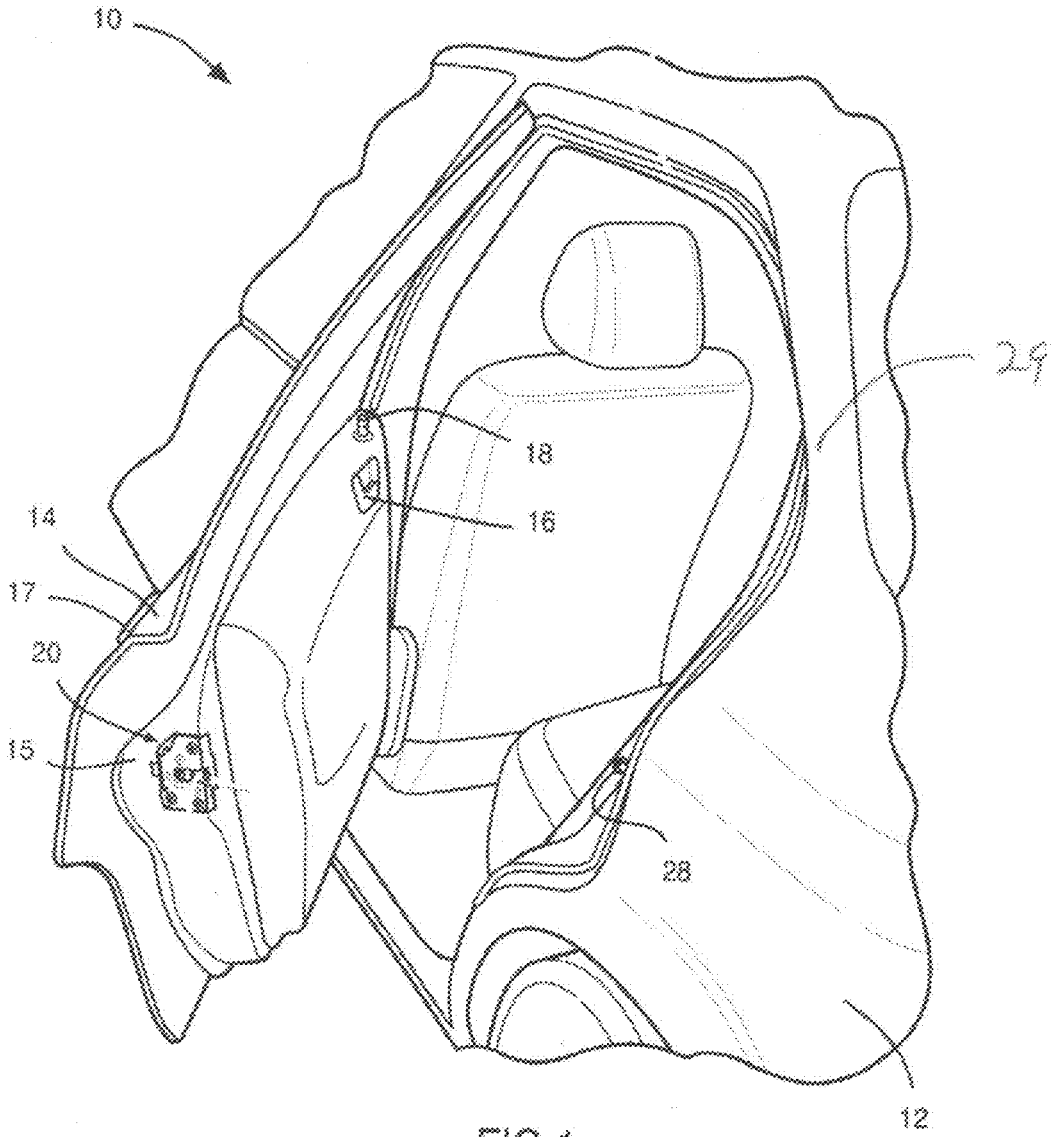
FIG. 1 shows a perspective view of a vehicle closure panel with associated latch.

FIG. 1 is a perspective view of a vehicle 10 that includes a vehicle body 12 and at least one vehicle door 14 (also referred to as closure panel 14). The vehicle door 14 includes a latch assembly 20 that is positioned on an edge face 15 and which is releasably engageable with a striker 28 on the vehicle body 12 to releasably hold the vehicle door 14 in a closed position. An outside door handle 17 and an inside door handle 16 are provided for opening the latch assembly 20 (i.e. for releasing the latch assembly 20 from the striker 28) to open the vehicle door 14. An optional lock knob 18 is shown and provides a visual indication of the lock state of the latch assembly 20 and may be operable to change the lock state between an unlocked position and a locked position. The closure panel 14 can be positioned adjacent to pillar 29 (of a body 12 of the vehicle 10) when closed, such that a hand of the vehicle user (e.g. driver) is inhibited from insertion between the pillar 29 and the closure panel 14. It is recognized that the latch assembly 20 can be configured as any type of latch (e.g. manual release, power release, with or without cinch functionality, etc.).

The latch assembly 20 has the advantage of incorporating a presentment mechanism 26 (see FIG. 2) as latch components mounted on a latch housing 30 (e.g. within the housing 30 interior). Further, the latch assembly 20 can also have an optional feature of using a common actuator (e.g. electric motor 32*a*—see FIG. 2) to operate both the presentment mechanism 26 and other latch components (e.g. ratchet 32*c*) to provide for a cinching operation (i.e. soft close).

The closure panel 14 (e.g. occupant ingress or egress controlling panels such as but not limited to vehicle doors and lift gates/hatches) is connected to the vehicle body 12 via one or more hinges (not shown) and the latch assembly 20 (e.g. for retaining the closure panel 14 in a closed position once closed). It is also recognized that the hinge can be configured as a biased hinge that can be configured to bias the closure panel 14 towards the open position and/or towards the closed position. In terms of a biased hinge used in combination with the latch assembly 20, the biased hinge can provide for assistance in presenting the closure panel 14 beyond where a ratchet 32*c* of the latch assembly 20 can influence positioning of the closure panel 14 (i.e. via operation of presentment members 32*e* of the presentment mechanism 26 as further described below). It is also recognized that the biased hinge can be configured as a door check mechanism integrated into the hinge and/or an independent door check assembly providing the bias. The closure panel 14 can have the mating latch component 28 (e.g. striker) mounted thereon for coupling with a respective latch assembly 20 (e.g. with the ratchet 32*c* component of the latch assembly 20) mounted on the vehicle body 12 (not shown). Alternative to that shown in FIG. 1, the latch assembly 20 can be mounted on the body 12 and the mating latch component 28 can be mounted on the closure panel 14.

Figure 2:
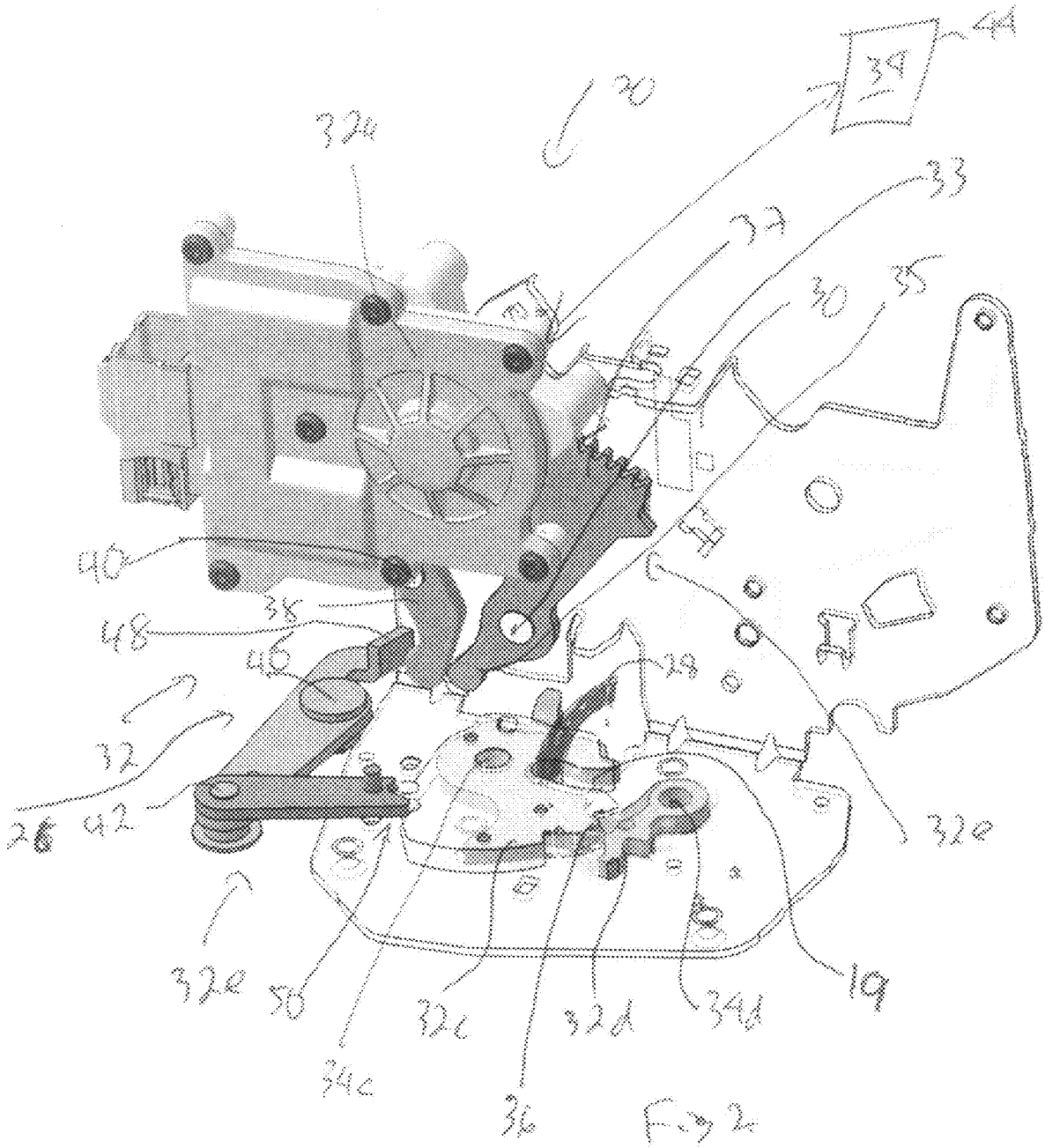
FIG. 2 shows a cutaway view of the latch of FIG. 1 in a cinched/primary position.

Referring to FIG. 2, shown is the latch assembly 20 having the latch housing 30 containing latch components 32 (e.g. latch electronic motor 32*a* and mechanical components such as gears (e.g. see reduction gear train 70—FIG. 8), ratchet 32*c*, pawl 32*d* and other presentment members 32*e* further described below) coupled to an electronic control unit 34 for controlling the electronic components (e.g. motor 32*a*, sensors/switches not shown, etc.) of the latch components 32 as well as optionally any sensors/switches (not shown) external to the latch housing 30, such as but not limited to door open/close position sensors (e.g. handle 16,17, knob 18, etc.). The ratchet 32*c* is biased by a ratchet biasing member (not shown), the presentment members 32*e* are used for actuating the ratchet 32*c* to pivot about pivot 34*c* once released by the pawl 32*d*. The pawl 32*d* can be biased into engagement with the ratchet 32*c* via a pawl biasing member (not shown), thereby holding the ratchet 32*c* in the closed position (e.g. primary or secondary position). Operation of the pawl 32*d*, i.e. pivot about pivot 34*d* against the bias of the pawl biasing member, can be performed manually or electronically assisted via operation of the handles 16,17 and/or command by the control unit 34.

The control unit 34 is also responsible for controlling operation of the electronic motor 32*a*, which is in turn responsible for moving latch lever 35 (e.g. via a rack and pinion 37 arrangement) which affects the positioning of the ratchet 32*c* and pawl 32*d* about their pivots 34*c*,34*d*, as further described below. The latch lever 35 can be pivotally attached to the latch housing 30 via pivot 33. The sensors/switches of the latch components 32 can be contact or contactless sensors/switches, as desired. The electronic control assembly 34 can be considered as an electronic control unit (ECU) integrated with the latch housing 30 that controls electronically one or more of the electrical system or subsystems associated with the latch assembly 20 in the vehicle body 12. For example, the electronic control assembly 34 can be programmed (via printed circuit board PCBA and associated control electronics such as memory and computer processor) to implement latch operational control related functionality of a body control module (BCM) and can be coupled electronically to a power supply and/or other computer related functionality of other vehicle control systems (by external connector) provided by controllers such as but not limited to a central control module (CCM) or general electronic module (GEM). Preferably the latch housing 30 is mounted or otherwise affixed on to a control housing 44 (or the control housing 44 is mounted or otherwise affixed on to the latch housing 30) in order to make the latch assembly 20, which is subsequently mounted to the closure panel 14 and/or vehicle body 12 (see FIG. 1). It is also recognized that the latch housing 30 can be spaced apart from the control housing 44 and thus the two housings 30,44 can be independently attached to the vehicle body 12 and/or closure panel 14 as independent components, as desired.

Referring again to FIG. 2, the latch 20 is shown in a closed state, such that the striker 28 is contained within a slot 19 of the ratchet 32*c*. However, the position of the latch lever 35 has been moved by the electronic motor 32*a* to a neutral position (from the optional cinched position shown in FIG. 3) to come into contact (or come into position adjacent to but not in contact with) with a presentment lever 38, in advance of operation of the presentment members 32*e* as further described below. For example, the latch lever 35 can be positioned between the presentment lever 38 and a cinch lever 27 of the ratchet 32*c*. In this example, the latch lever 35 can be operated in one direction (e.g. pivoted about the pivot 33) to influence the position of the ratchet 32*c* during cinch via driving of the cinch lever 27, while can be operated in the other direction (e.g. pivoted about the pivot 33) to influence the position of the ratchet 32*c* during presentment via driving of the presentment lever 38.

Figure 3:
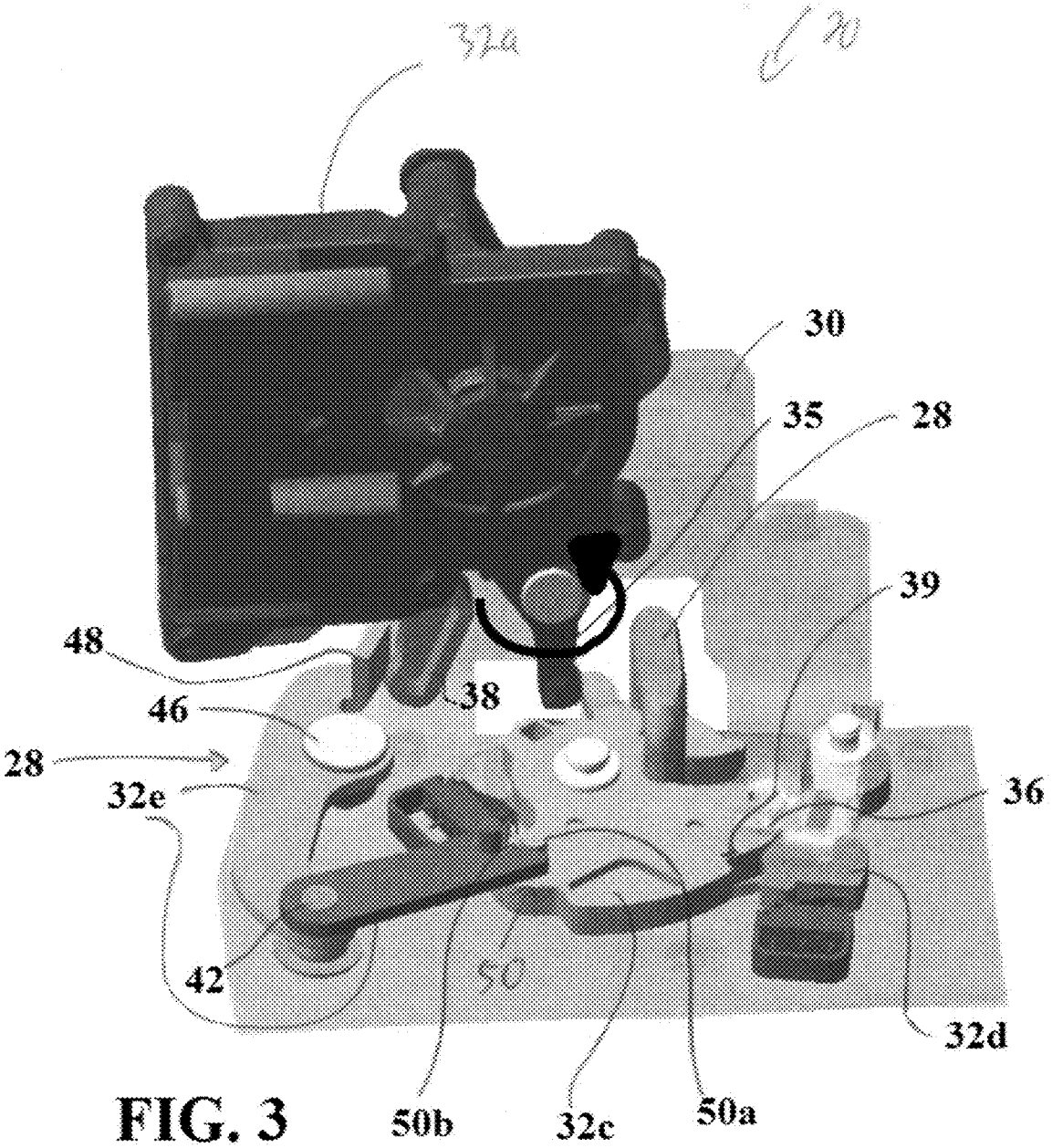
FIG. 3 shows a further cutaway view of the latch of FIG. 1 in the cinched/primary position.
Figure 5:
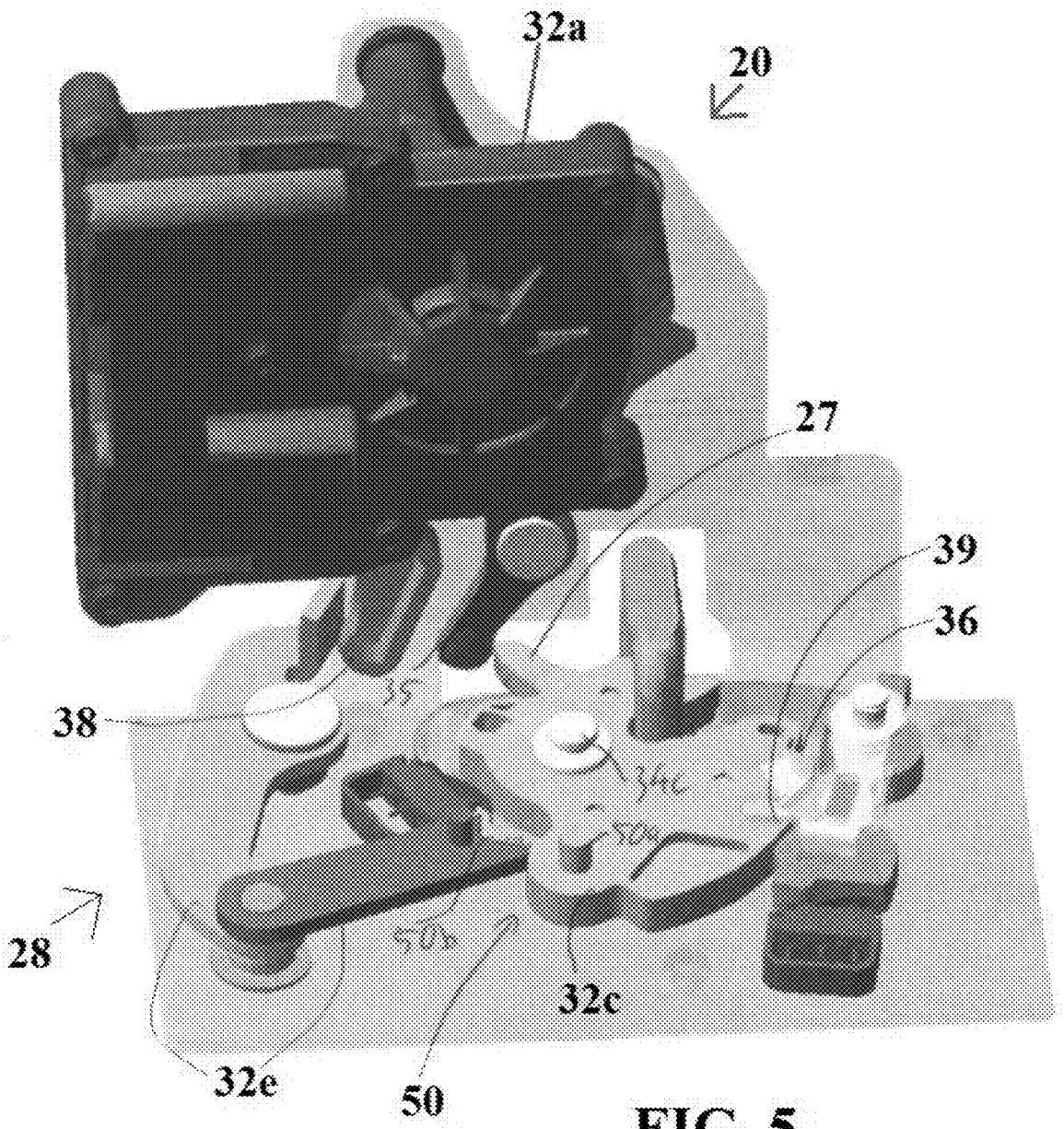
FIG. 5 shows a further cutaway view of the latch of FIG. 1 in an secondary position.

In operation of the ratchet 32*c* and the pawl 32*d*, as further described below, these components 32*c*,*d* each pivot about their respective pivot locations 34*c*,34*d*. As shown in FIGS. 2, 3, the pawl 32*d* is engaged with a primary position detent 36 of the ratchet 32*c*, which can be regarded as the fully closed or cinched state of the latch 20. This cinched position (e.g. primary position) is compared to the uncinched state (e.g. secondary position) as shown in FIG. 5, such that the pawl 32*d* is engaged with a latched or secondary position detent 39. For example in FIG. 5, actuation of the latch lever 35 (e.g. via operation of the electric motor 32*a*) against ratchet lever 27 causes rotation of the ratchet 32*c* about pivot 34*c* to cause the pawl 32*d* to rotate against the pawl bias and move from secondary position detent 39 to primary position detent 36 of the ratchet 32*c* (see FIG. 3). Concurrent with movement of the pawl 32*d*, rotation of the ratchet 32*c* causes a pin 50*a* to become engaged with a slot 50*b* of a (pin/slot) coupling 50 between the ratchet 32*c* and the presentment member(s) 32*e* (see FIGS. 3,5). As noted, the latch assembly 20 can optionally include the cinching operation of the latch lever 35, which automatically engages the ratchet 32*c* in the primary latch position when the intermediate secondary latch position is reached, as operated by the latch electric motor 32*a*.

Referring again to FIGS. 2,3, the latch components 32 include the presentment mechanism 26 of the one or more presentment members 32*e* also operated by the latch electric motor 32*a* via the presentment lever 38 (e.g. also considered part of the presentment mechanism 26), further described below. The presentment lever 38 is mounted on the latch housing 30 via pivot 40 and can be moved by the latch lever 35, thereby advantageously providing for an integrated operation of latch open/close operation of the ratchet 32*c* and the pawl 32*d* with the operation of the presentment members 32*e* via the same electronic motor 32*a*. As such, advantageously the same latch lever 35 can be used to actuate the presentment lever 38 (in order to perform the presentment operation) as well as to actuate the ratchet 32*c* in order to perform a cinch (e.g. positioning of the ratchet 32*c* from a secondary to a primary latch position) operation of the latch assembly 20. The one or more presentment members 32*e* couple operation of the presentment lever 38 with the ratchet 32*c*, such that the present members 32*e* can be pivot about one or more pivot locations 42,46 during operation of the presentment lever 38. As such, one end of the presentment members 32*e* is coupled to the presentment lever 38 by abutment 48 and the other end of the one or more presentment members 32*e* is coupled to the ratchet 32*c* by the coupling 50. It is recognized that other coupling arrangements of the presentment member(s) 32*e* with the presentment lever 38 and ratchet 32*c* can be envisioned, as desired. As described above, it is clear that the latch components of the latch assembly 20 include the presentment mechanism 26 (e.g. one or more presentment members 32*e*, presentment lever 38 and coupling via the coupling 50 with the ratchet 32*c*).

The presentment members 32*e* can be configured, by example, as a first presentment member 32*e* (having the abutment 48) coupled to the latch housing 30 at pivot 46, with a second presentment member 32*e* (having the coupling 50—e.g. notch and pin arrangement) coupled to the first presentment member 32*e* at pivot 42. However, it is recognized that other alternative structural configurations of the presentment mechanism 26 can be envisioned other than described, as long as the presentment mechanism 26 is configured to act on the ratchet 32*c* in order to push the ratchet 32*c* in order to move the move the striker 28 out of the slot 19 and into the presentment position). Further, actuation of the presentment mechanism 26 can be done by an actuator such as the electric motor 32*a* (i.e. power presentment) as described, or by other means (e.g. manual presentment) as desired.

Figure 4:
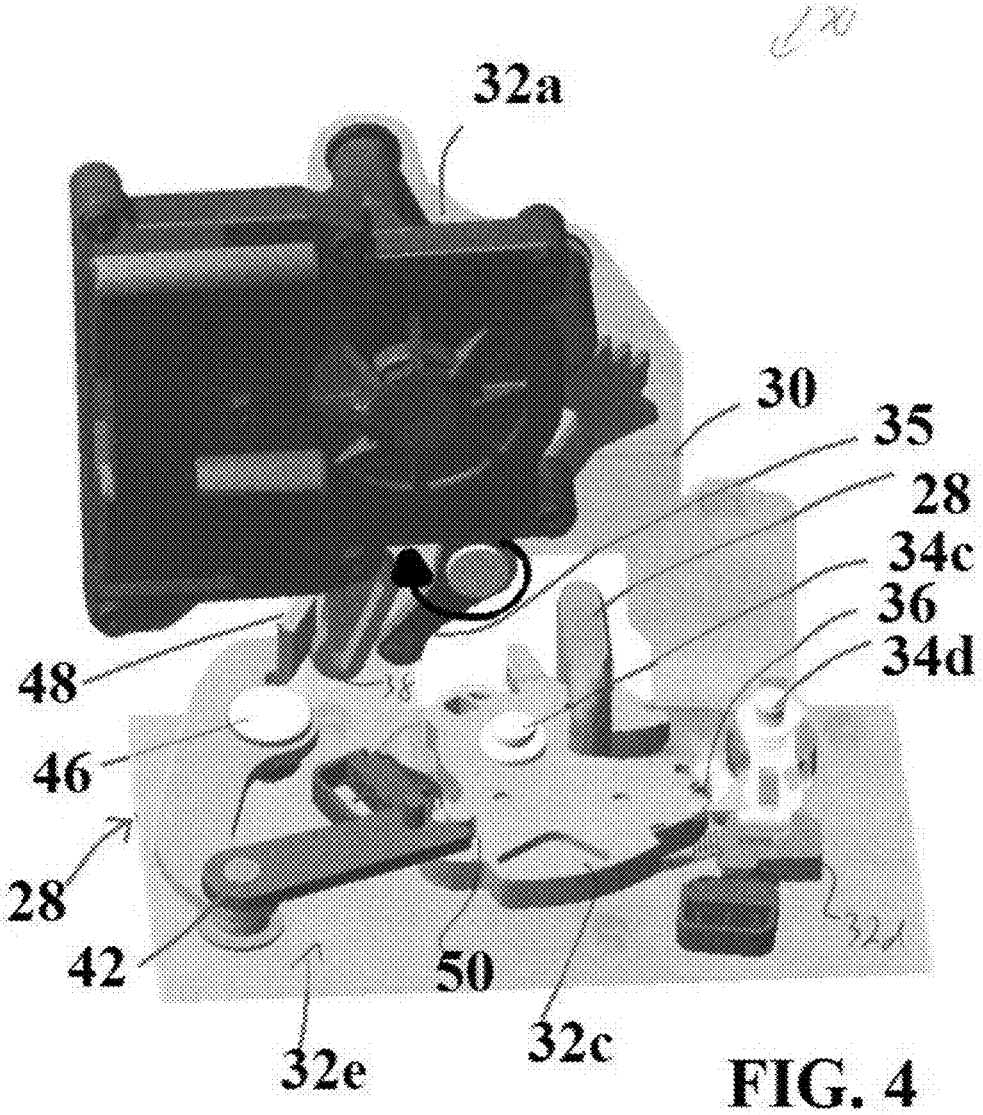
FIG. 4 shows a further cutaway view of the latch of FIG. 1 in an released position.
Figure 6:
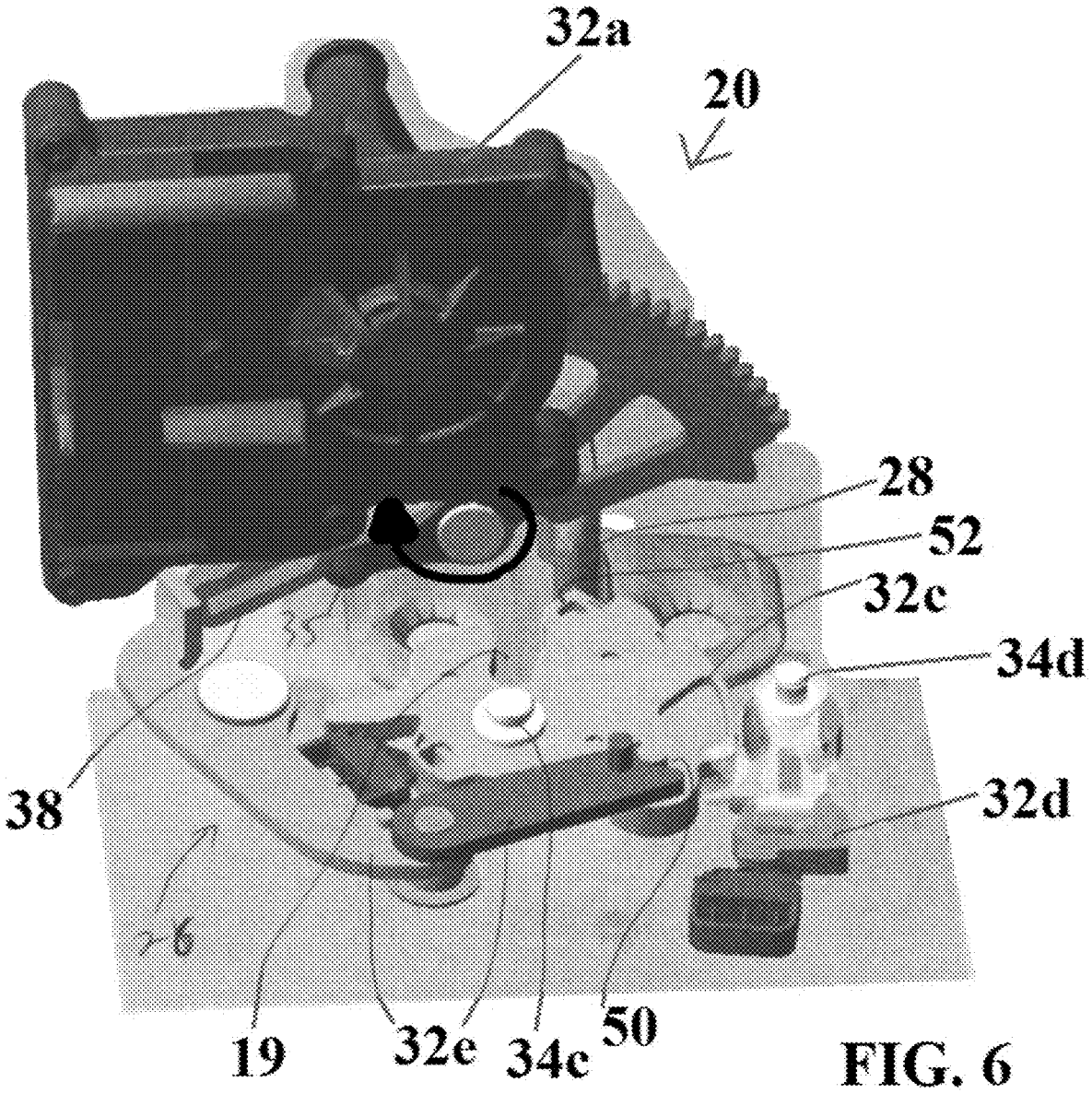
FIG. 6 shows a further cutaway view of the latch of FIG. 5 in a presentment position.

Referring to FIG. 4, pawl 32*d* is removed from engagement with the primary position detent 36 (i.e. rotated against the pawl bias about pivot 34*d*, which can be performed as a power release of the pawl 32*d* or as a manual release of the pawl 32*d* as desired). Next, operation of the electronic motor 32*a* causes the presentment lever 38 to move (e.g. pivot) away from the ratchet lever 37 (as shown in FIG. 4) and actuate abutment 48 of the presentment member(s) 32*e*, which causes movement (i.e. pivot) of the presentment members 32*e* to cause rotation of the ratchet 32*c* about pivot 34*c* and thus move the striker 28 out of the slot 19 (see FIG. 6), which causes relative movement between the closure panel 14 and the pillar 29 (see FIG. 1) to place the latch 20 in the fully open position. Further rotation of the ratchet 32*c* where the striker 28 can rest against abutment 52 of the ratchet 32*c* pushes the striker 28 out of the slot 19 defining the presentment position (FIG. 6). As such, movement of the striker 28 from the latch released position (shown in FIG. 4) to the presentment position (shown in FIG. 6) results in the closure panel 14 (upon which the striker 28 is mounted, by example) to be displaced by a relative presentment distance (e.g. 30-35 mm) between the closure panel 14 and the pillar 29. Accordingly, the presentment position can be such that the hand of the vehicle user can be inserted between the pillar 29 and the closure panel 14, thus providing for further manual opening of the closure panel 14 under control of the vehicle user.

As shown in FIG. 2, the latch assembly 20 for the closure panel 14 of the vehicle 10 can include the latch housing 30 with latch components of 1) the ratchet 32*c* rotationally mounted to the housing 30 and moveable between a striker 28 present position where the ratchet 32*c* can be positioned to present the striker 28 and (e.g. two) distinct striker capture positions (via detents 36,39) where the ratchet 32*c* is positioned to retain the striker 28, wherein the two distinct striker capture positions (via detents 36,39) can include the secondary latched position and the primary latched position (it is understood that the latch assembly 20 can optionally include the cinch operation performed by the electric motor 32*a*), 2) the pawl 32*d* rotationally mounted to the housing 30 and moveable between the ratchet checking position where the pawl 32*d* is positioned to hold the ratchet 32*c* in one of its secondary and primary latched positions and the ratchet release position where the pawl 32*d* permits movement of the ratchet 32*c* (under direction of the ratchet biasing element and presentment mechanism 26) to the striker release position; 3) the presentment mechanism 26 including the presentment member(s) 32*e* configured to selectively engage the ratchet 32*c* when the pawl 32*d* moves from the ratchet checking position to the ratchet release position; and 4) a drive mechanism (e.g. electric motor 32*a*) configured to drive the presentment mechanism 26 into engagement with the ratchet 32*c* such that the ratchet 32*c* moves to the striker 28 present position (i.e. the striker 28 is moved out of the slot 19 and into the striker 28 presentment position).

As provided above, advantageously the employment of the presentment lever 38 with associated presentment member(s) 32*e* can optionally provide for the same electronic motor 32*a* to be used for both cinching operation (i.e. moving pawl 32*d* from detent 39 to detent 36) as well as moving the striker 28 from the latch released position to the striker 28 presentment position. For example, as discussed above, operation of the latch lever 35 in a first direction provides for cinching (e.g. soft close) operation between the ratchet 32*c* and the pawl 32*d*. Further, operation of the latch lever 35 in a second direction (e.g. opposite to the first direction) provides for the presentment operation of the striker 28 by moving the striker 28 out of the slot 19 of the ratchet 32*c* and into the striker 28 presentment position (see FIG. 6).

It is recognized that upon returning the closure panel 14 towards the closed position, i.e. closing of the closure panel 14 by the vehicle user, reengagement of the striker 28 with the slot 19 of the ratchet 32*c* (see FIG. 6) can cause rotation of the ratchet 32*c* about pivot 34*c* and thus cause the coupling 50 to drive the presentment members 32*e* back into their original unlatched position (see FIG. 4). Further driving of the striker 28 into the slot 19 would cause movement of the ratchet 32*c* to place the presentment members 32*e* in a neutral position (see FIG. 2). Alternatively, the presentment members 32*e* can be biased to a neutral position by a biasing member (not shown). Subsequent operation of the electric motor 32*a* would cause the latch lever 35 to act against ratchet lever 37 and thus engage the pawl 32*d* from detent 36 to detent 39, thus positioning the latch 20 in the cinched position (see FIG. 5).

Figure 7:
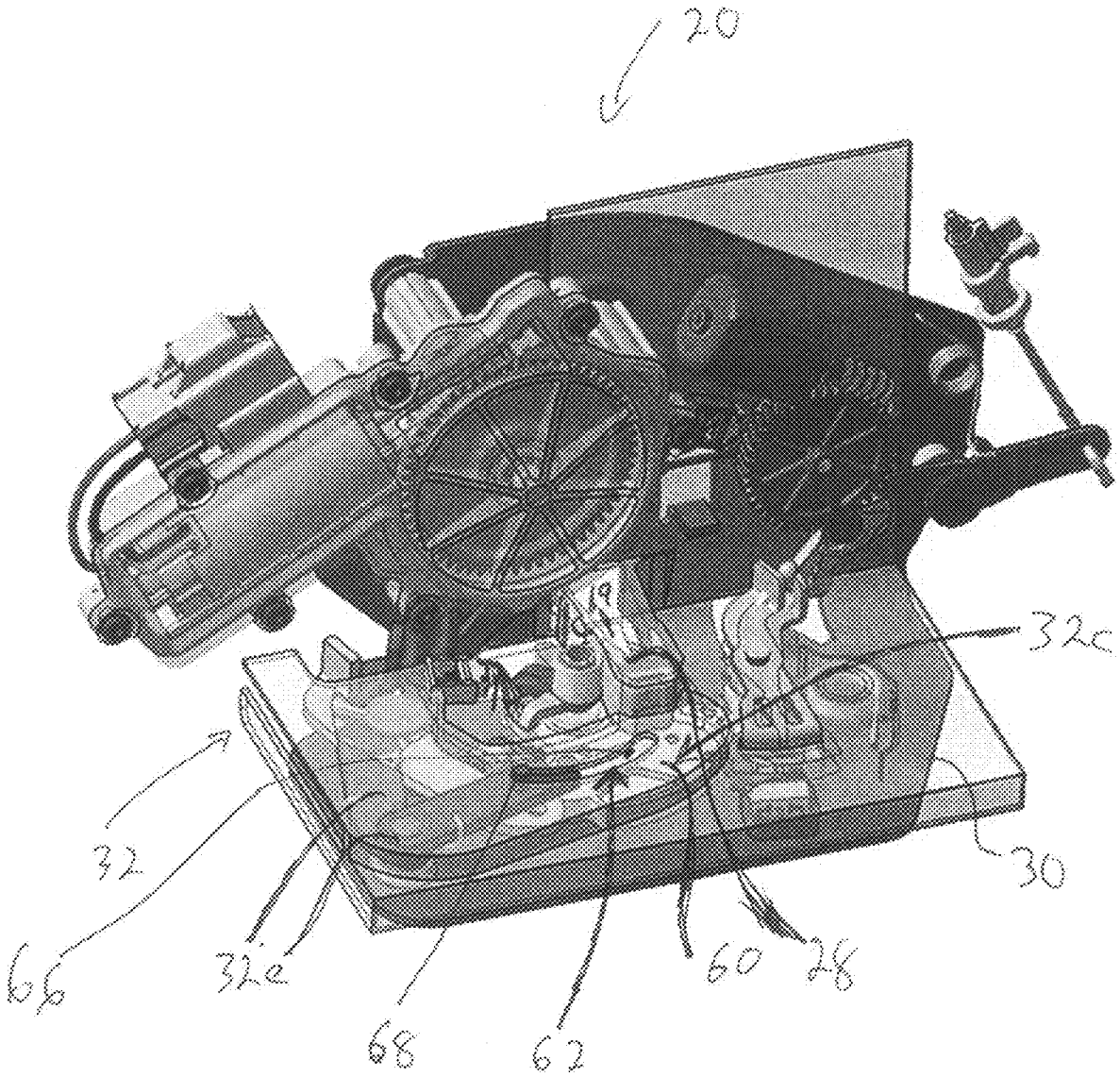
FIG. 7 shows a further embodiment of the latch of FIG. 2.

Referring to FIG. 7, shown is a further embodiment of the presentment mechanism 26 for the latch assembly 20. The presentment members 32 can also include a guide plate 60 shown in ghosted view with the underlying ratchet 32*c*. The guide plate 60 can be fixed to the latch housing 30 and can include a guide 62 coupled to the presentment member(s) 32*e* for facilitating that the presentment member(s) 32*e* follow the operational path of the ratchet 32*c* during its movement (e.g. causing movement of the striker 28 within the slot 19 of the ratchet 32*c* as the ratchet 32*c* rotates about its pivot 34*c*—see FIG. 2). The guide 62 can have a number of different physical implementations to facilitate the following of the operational path, such as by example only, a channel 66 in the guide plate 62 for cooperating with a pin 68 of the presentment member(s) 32*e*. In the present example, the guide plate 62 overlays the presentment member(s) 32*e* and the ratchet 32*c*. Following of the operational path of the ratchet 32*c* by the presentment member(s) 32*e* is preferred, in order to facilitate the presentment member(s) 32*e* remaining engaged with the ratchet 32*c* as the ratchet 32*c* pivots about the pivot 34*c*.

Figure 8:
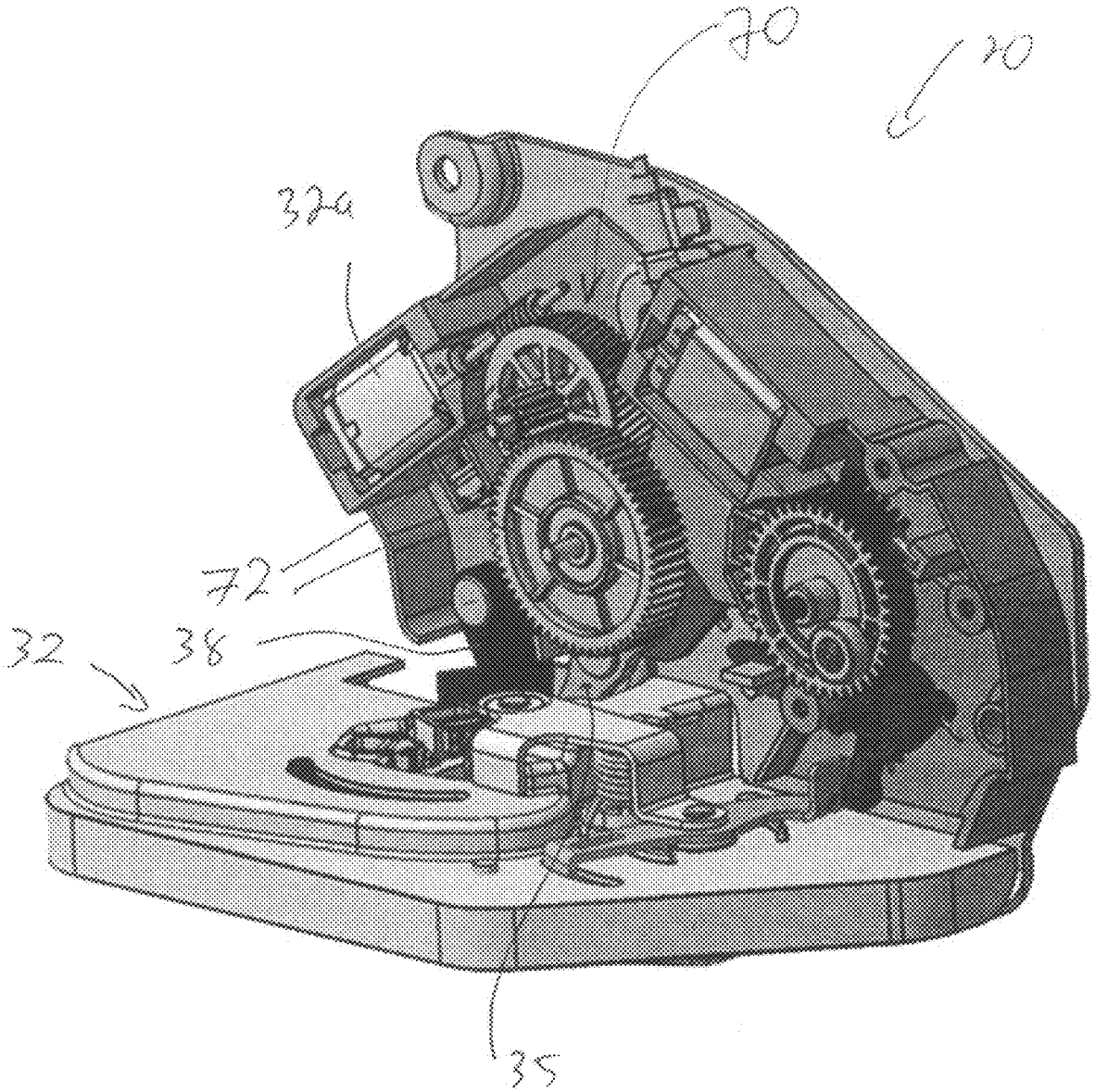
FIG. 8 shows a still further embodiment of the latch of FIG. 2.

Referring to FIG. 8, shown is a further embodiment of the latch assembly 20 having a reduction gear train 70 having two or more gears 72 engaged between the latch electric motor 32*a* and the latch lever 35, whereby the latch lever 35 is responsible for affecting the position of the ratchet 32*c* and pawl 32*d* about their pivots 34*c*, 34*d* as described herein. It is recognized the reduction gear train 70 can amplify input torque provided by the latch electric motor 32*a*, thus facilitating the use of a smaller (i.e. less powerful and therefore of lower weight/power requirement) motor than that of other embodiments using a single driven gear.

Figure 9:
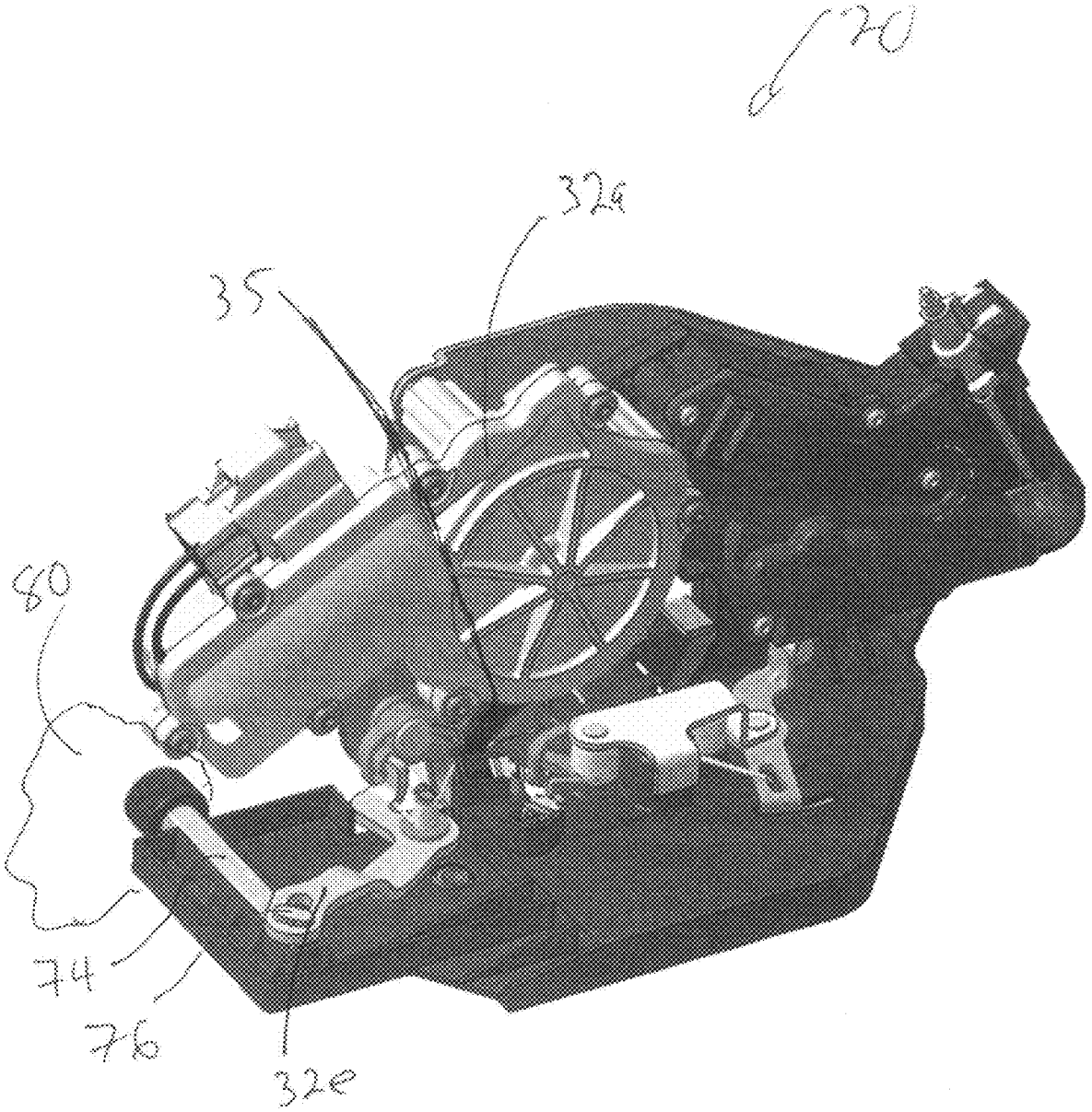
FIG. 9 shows a still further embodiment of the latch of FIG. 2.

Referring to FIG. 9, shown is a still further alternative embodiment of the latch assembly 20. The latch electric motor 32*a* can drive the latch lever 35, which can be coupled to the presentment member(s) 32*e* used to actuate a body member 74 rather than directly on the ratchet 32*c* (e.g. by way of the coupling 50—see FIG. 2). Accordingly, the presentment member(s) 32*e* are coupled to the body member 74 by way of a coupling 76 (e.g. a pin and slot arrangement). In operation, upon actuation of the body member 74 (e.g. push member) via displacement of the presentment member (s) 32*e* under influence of the latch member 35, the body member 74 acts on an adjacent body surface 80 (e.g. vehicle body 12—see FIG. 1) in order to effect movement of the closure panel 14 to the presentment position (for example see FIG. 6). In this example, it is assumed that the latch assembly 20 is positioned on the closure panel 14 (see FIG. 1) and therefore the body member 74 is configured to act on the vehicle body 12 (i.e. the adjacent body surface 80) upon actuation. Alternatively, if the latch assembly 20 is situated on the vehicle body 12, then the adjacent body surface 80 could be considered as the closure panel 14 itself. In tandem to the body member 74 acting (e.g. pushing) on the adjacent body surface 80, movement of the striker 28 from the latch released position (shown in FIG. 4) to the presentment position (shown in FIG. 6) can be facilitated via release of the ratchet 32*c* from influence/retention of the pawl 32*d* prior to actuation of the body member 74. The result of actuation of the body member 74 can be the closure panel 14 (e.g. upon which the striker 28 is mounted) to be displaced by a relative presentment distance (e.g. 30-35 mm) between the closure panel 14 and the pillar 29. Accordingly, the presentment position can be such that the hand of the vehicle user can be inserted between the pillar 29 and the closure panel 14, thus providing for further manual opening of the closure panel 14 under control of the vehicle user, see FIG. 1.

It is recognized that the above described presentment can be advantageous in situations where opening of the closure panel 14 is resisted by ice buildup (e.g. due to freezing rain). As such, operation of the presentment members 32*e* can provide for overcoming of the resistance by breaking the ice buildup, thus operating as an ice breaking mechanism.

Those in the art will understand that a number of variations may be made in the disclosed embodiments, all without departing from the scope of the invention, which is defined solely by the appended claims.

We claim:

1. A latch assembly for a closure panel of a vehicle, the latch assembly including:

a latch housing;

a ratchet and pawl pivotally coupled to the latch housing, the ratchet for interaction with a striker such that one of the latch assembly and the striker being mounted on the closure panel and the other of the latch assembly and the striker being mounted on a body of the vehicle;

a presentment mechanism mounted to the latch housing having presentment members;

a latch lever mounted to the latch housing and operatively coupled to the presentment mechanism; and an actuator for 1) operating the latch lever in a first direction to move the latch lever coupled with the presentment mechanism to drive the presentment members for influencing a position of the ratchet during presentment of the striker out of the slot of the ratchet to a presentment position or 2) for operating the latch lever in a second direction to perform a cinch operation by moving the ratchet from a secondary position to a primary position.

2. The latch assembly of claim 1, wherein the presentment position is represented by a relative presentment distance provided between the closure panel and a pillar of the vehicle.

3. The latch assembly of claim 1 further comprising a secondary position detent on the ratchet corresponding with the secondary position and a primary position detent on the ratchet corresponding with the primary position, wherein the pawl is configured to selectively hold the ratchet in the secondary position and in the primary position.

4. The latch assembly of claim 1, wherein the actuator moves in the first direction for said perform the cinch operation and moves in the second direction for said presentment of the striker to the presentment position.

5. The latch assembly of claim 4, wherein the latch lever is positioned between the ratchet and a presentment lever of the presentment mechanism.

6. The latch assembly of claim 1, wherein the actuator is an electric motor.

7. The latch assembly of claim 1, wherein the presentment mechanism includes a presentment lever positioned adjacent to an end of one of the presentment members and an end of another one of the present members is positioned adjacent to the ratchet, such that the presentment lever provides said operatively coupled.

8. The latch assembly of claim 7 further comprising the presentment members being pivotally mounted to the latch housing.

9. The latch assembly of claim 8, wherein the presentment members are a pair of presentment members, such that said one of the presentment members is said pivotally mounted to the latch housing and said another one of the presentment members is pivotally mounted to said one of the presentment members.

10. The latch assembly of claim 9, wherein said one of the presentment members includes an abutment positioned adjacent to the presentment lever and said another one of the presentment members includes a coupling with the ratchet.

11. The latch assembly of claim 7, wherein the presentment lever is pivotally mounted to the latch housing.

12. The latch assembly of claim 11, wherein the actuator is selected from the group consisting of a manual release and a power release.

13. The latch assembly of claim 1, wherein the latch lever is pivotally mounted to the latch housing.

14. The latch assembly of claim 1, wherein the presentment mechanism is mounted in the latch housing adjacent to other latch components of the ratchet and the pawl.

15. The latch assembly of claim 1 further comprising a guide for guiding movement of the presentment members during the presentment of the striker out of the slot of the ratchet to the presentment position.

16. The latch assembly of claim 1 further comprising reduction gear train engaged between the actuator and the latch lever.

17. The latch assembly of claim 1 further comprising a body member for acting on a body surface of the vehicle, wherein the presentment mechanism includes a presentment lever positioned adjacent to one end of the presentment members and the other end of the present members is positioned adjacent to the body member, such that the presentment lever provides said operatively coupled.

18. The latch assembly of claim 17, wherein the body surface is selected from the group consisting of the body and the closure panel.

19. The latch assembly of claim 1 further comprising the presentment mechanism having a presentment lever, such that the presentment lever provides said operatively coupled.

* * * * *